United States Patent [19]

Eigenmann

[11] 4,012,247

[45] Mar. 15, 1977

[54] METHOD AND DEVICES FOR ROAD SURFACE MARKING

[76] Inventor: Ludwig Eigenmann, Vacallo, Ticino, Switzerland

[22] Filed: Jan. 26, 1976

[21] Appl. No.: 652,524

[30] Foreign Application Priority Data

Jan. 27, 1975 Italy ..... 19621/75

[52] U.S. Cl. ..... 156/71; 222/145; 259/8; 404/72; 404/111; 427/137

[51] Int. Cl.[2] ..... E01C 19/00

[58] Field of Search ..... 156/71; 409/72, 94, 409/79, 115, 111; 222/145; 259/5, 6, 7, 8; 427/137

[56] References Cited

UNITED STATES PATENTS

| | | | |
|---|---|---|---|
| 3,682,054 | 8/1972 | MacPhail | 404/94 |
| 3,844,668 | 10/1974 | Winters | 404/72 |
| 3,844,669 | 10/1974 | Eigenmann | 404/94 |
| 3,902,939 | 9/1975 | Eigenmann | 404/94 |

*Primary Examiner*—Edward G. Whitby
*Attorney, Agent, or Firm*—Michael J. Striker

[57] ABSTRACT

There is described a method for road surface marking with tape material, including the steps of forming an essentially bituminous primer layer on such surface and then pressingly laying a prefabricated tape material on said primer layer, such layer being formed with an essentially adhesive composition having a relatively low viscosity when contacted with the road surface and comprising a substantial percentage of cross-linkable components at least part of which is hydrophilous. The layer is capable of attaining within a few minutes a viscosity of about $10^5$ cp and then further hardening to provide a final resistance to horizontal stresses applied to the tape material of at least 3 kg/cm$^2$. There also are described devices for promoting cross-linking by pre-forming pre-polymers of a two-component reactive composition.

18 Claims, 5 Drawing Figures

FIG. 1
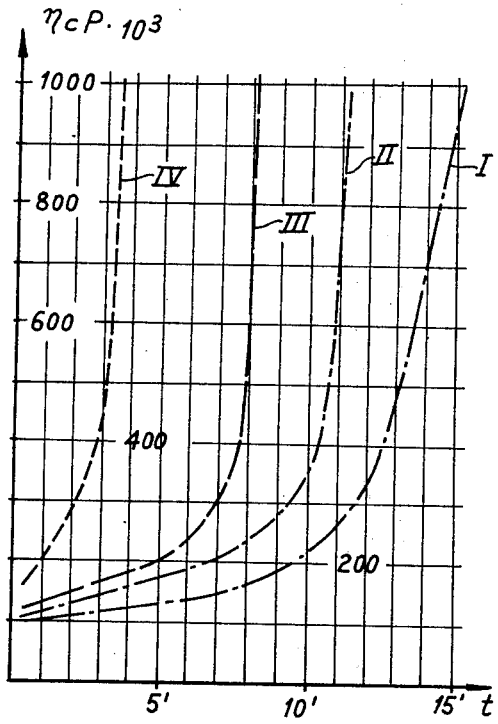
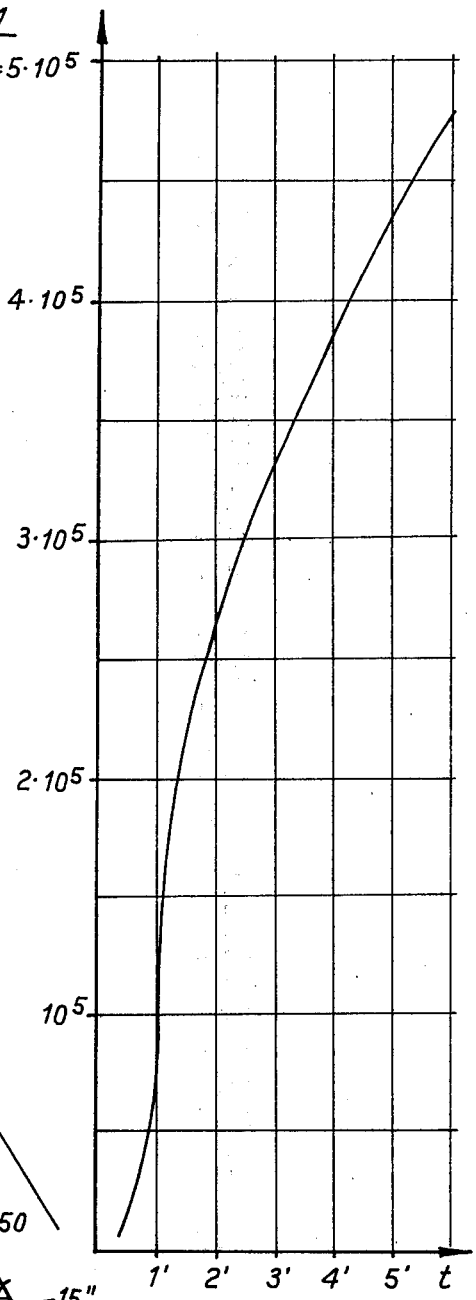
FIG. 2
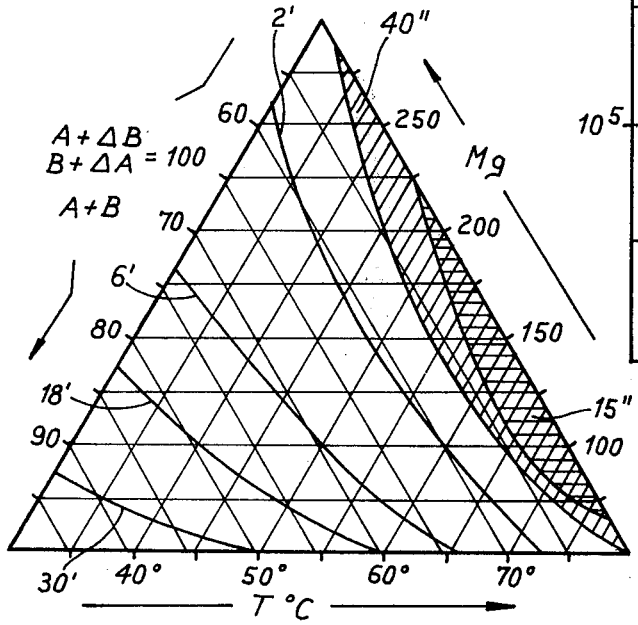
FIG. 3

METHOD AND DEVICES FOR ROAD SURFACE MARKING

BACKGROUND OF THE INVENTION

1. Field of the Invention

This invention is generally concerned with the art of road and highway marking with strip or tape material, namely for providing a road or highway with centre-lines or with traffic lane-dividing lines or the like, prevailingly but not exclusively arranged lengthwise of the road.

More particularly, the present invention is concerned with the art of providing traffic signs of the above type, consisting of prefabricated tape material laid on the road surface upon a relatively thin underlayer generally comprising bitumen or asphalt or the like capable of thoroughly filling any road surface porosity, holes and hollows thus providing a tape material receiving, impervious, flat and planar surface which achieves a firm and permanent bond of the tape material to the road pavement.

Such underlayer is generally and usually indicated, in the art of road surface marking as above, by the word "primer layer" and therefore said expression will be made use of as this description proceeds and in the appended claims.

This invention is principally concerned with the art of compounding, forming, applying on the road pavement and taking advantage of a new and advantageous primer layer as hereinbelow set forth.

2. Description of the Prior Art

The art of road surface marking with tape material is a well worked one and a wide technical and patent literature thereabout exists. With relation to this art reference is herein made to the U.S. Pat. Nos. 3,399,607 and 3,587,415, of the present Applicant. As far as the machines and devices for providing a road pavement with such markings are concerned, reference is also made to the U.S. Pat. Nos. 3,007,838, 3,155,564, 3,235,436, 3,262,375 and 3,844,669, of the same Applicant.

It is also known that in relatively recent years the road marking tape materials have been substantially improved by making them "non skidding", that is adapted to provide a sure frictional adherence with the vehicles' tires, such a tape material being described, for example in the Applicant's U.S. Patent No. 3,782,842. This provision, which is essential for traffic safety, has made it imperative that the tape material shall be most firmly secured to the road pavement to prevent detachment and stripping of the tape from said pavement, under the extremely severe inertial force exerted by fast and heavy vehicles such as in the event of emergency braking, accelerations and so on.

It is further known to those skilled in the art that the entire cycle of operations required for marking a road surface involves a considerable overall time. Such time will seriously disturb the availability of the highway, and the traffic must be kept far removed from the areas to be marked. The time involved in the process of complete setting of the primer layer, from the very time at which the primer layer composition is laid in contact with the road pavement to the very time at which the same composition has been hardened to form a consistent and load and stress resistant layer, is principally responsible for the evidently undesirable traffic disturbance.

It is therefore the principal object of the invention to provide a new and advantageous method for road surface marking, comprising the essential steps of forming a primer layer on said pavement and laying a prefabricated mark-forming tape material, the invention including a solution to the sharply antithetical problems of (i) shortening as much as possible such overall time and therefore the traffic disturbance and (ii) providing the most firm and permanent binding of the tape material to the road pavement by means of a completely set and properly hardened primer layer which is intimately secured to said pavement.

SUMMARY OF THE INVENTION

An essential basis of the invention consists in the analysis of the said overall time, as follows: 1st Period: from the very time at which the primer layer forming composition is caused to contact the roadway pavement surface to the time at which the laying down and pressing of the tape material on said layer have been completed.

Therefore this 1st Period comprises the steps of pouring or otherwise laying a substantially fluidified composition on the road pavement, causing the intimate penetration of said composition in the pores of such pavement, promoting a certain viscosity of the laid down composition to obtain a layer, doctoring said layer to provide the same with an upper smooth face, and laying and pressing the tape material on the thus formed primer layer face when said layer has attained a consistency sufficient to resist said laying and pressing. It is evident that such steps will occur, at any given location of the area to be marked, during the passage of the road-marking machine over said location.

2nd Period: from the end of said 1st Period to the time at which the marked area can be safely re-opened to traffic, the term "safely" meaning herein that the sign has become able to resist, without damage, the regular traffic, taking into consideration the type and density of the traffic and the specific roadway being marked, but the term safely allowing for possibility that the freshly formed marking might be spoiled upon the occurrence of a exceptional that is a statistically rare stress (such as an emergency braking) applied to said marking, which latter individually forms a minor part of the entire road surface area open to traffic.

3rd Period: form the end of the 2nd Period to the time at which the primer layer has been completely set and the entire stratified marking structure has acquired its final and best status and ability to resist any stress which it has been designed to resist.

The above analysis has been conceived, upon the premise that it is not worth keeping the traffic far from a freshly marked area for a time longer than that required for the marking to become "reasonably" resistant to the statistically most common traffic stresses. Other premises of the above analysis are:

a. The primer layer composition should be nearly liquid and capable of properly "wetting" when contacted with the road pavement;

b. the laying down and pressing of the tape material on the primer layer requires that the compound which forms such layer will have a viscosity of not less than $10^3$ cP (centipoises) and preferably of about $10^4$ cP;

c. the opening of the marked area to traffic should occur when the primer layer is so hardened as to provide a resistance of at least 1.5 Kg/cm$^2$ to frictional stresses horizontally applied to the tape surface. This resistance is generally provided when the average viscosity of the primer layer compound is in the range from $10^5$ to $10^6$ cP;

d. the primer layer, when completely set, should provide a bond between the tape and the road pavement such which is such as to raise the above resistance up to at least about 3 $Kg/cm^2$.

On the other hand, when the atmosphere has a high moisture content, the water content in the road pavement can be such as to prejudice and also prevent the intimate binding of the primer layer to said pavement, and even an intense heating of the road surface, such as by means of powerful burners, cannot eliminate this undesired status of the road. This is apart from the cost of such heating.

According to the invention, it has been found that the above and other problems can be satisfactorily solved by forming the primer layer from a suitable composition which contains a consistently high percentage of cross-linkable, at least partially hydrophilous resinous agents in liquid state, the said composition forming an essentially liquid, more or less viscous mass, which can be caused to cross-link in substantial absence of solvents provided that the above stated requirement of a rapid setting to a viscosity of $10^5$ to $10^6$ cP is satisfied in order to permit prompt re-opening of the marked area to the traffic. According to an important feature of the invention, said hydrophilous components are selected from among those which provide a substantial contribution to the speed of the cross-linking process at ambient temperature. According to a preferred embodiment of such feature, there is made use of urethane radicals. It has been found that such radicals can, when made use of as prevailing components of the cross-linkable compound, or as additives for or modifiers of epoxy resins, provide a previously unforeseeable cross-linking speed at the temperature of the road pavement. It has been also found that even epoxy radicals can promote a surprising activity, at said temperature, when forming part of pre-polymers (that is partially formed polymers) in the presence of monomers.

According to a preferred embodiment, as activator of the co-reagents there is made use of a pre-polymer obtained by the cross-linking of part of the same co-reagents, the amounts of such pre-polymer to be added being fed to the outlet of the apparatus in a regulated manner. The best results are attained by making use of a low percentage of such pre-polymer the molecules of which can be extended by mass-induction. It has been found that unexpectedly short induction times will sharply speed up the cross-linking which is to be completed within the already applied primer layer.

These and other features of the invention will be hereinbelow described, reference being made to the accompanying drawings.

BRIEF DESCRIPTION OF THE DRAWINGS

FIG. 1 is a graph which illustrates the increase in the viscosity $\eta$ in centipoises (cP) times $10^5$ ($\eta$ cP.$10^5$) versus the time ($t$) in minutes for an epoxy-urethane type composition;

FIG. 2 is another graph which illustrates the most interesting portions of similar curves referred to various composition;

FIG. 3 is a ternary graph which illustrates certain relationships between temperature and amount of pre-polymer, for attaining the desired viscosity of $6 \times 10^5$;

DESCRIPTION OF THE PREFERRED EMBODIMENTS

Figure 4:
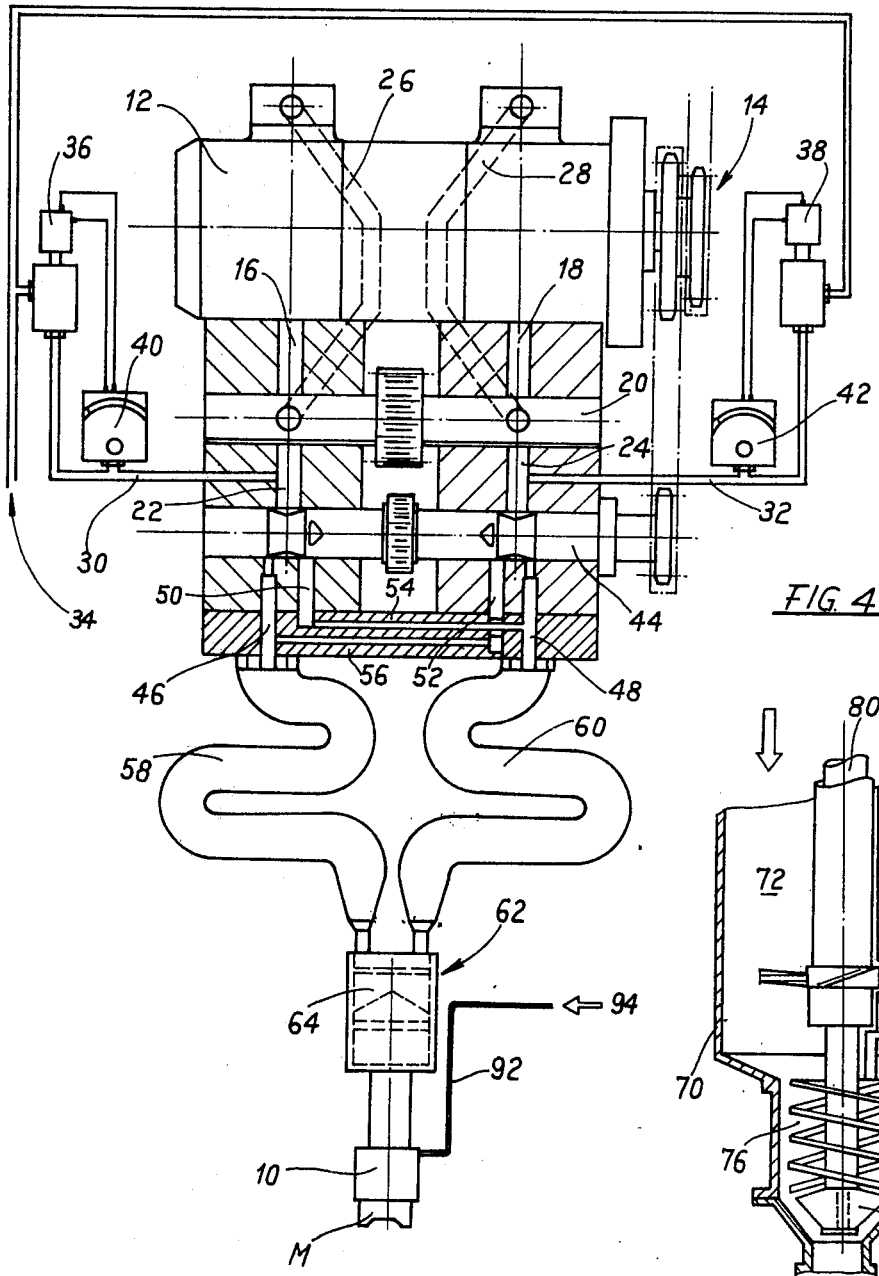
FIG. 4 is a somewhat simplified partly sectional and partly side view of an apparatus for producing a cross-linkable mixture by making use of pre-polymers.

Referring first to FIG. 1, the graph is self-explanatory and shows that a basically urethane composition can provide a primer layer which allows the marked area to be re-opened to the traffic, about 4 minutes and preferably about 6 minutes after the spreading of the composition at 100° C on the road pavement.

The graph of FIG. 2 comprises a curve I which illustrates the increase in viscosity ($\eta$ cP.$10^3$) of a two component epoxy composition. Curve II illustrates how such increase can be improved by adding 30% by weight of pre-polymers. Curve III illustrates the further improvement provided by the use of a three-component composition. Curve IV illustrates the improvement provided by heating. As a matter of fact, said curve IV refers to the composition of curve II, but at a temperature of 50° C.

The ternary graph of FIG. 3 is to be considered upon the premise that a pre-polymer (as meant herein and in the appended claims) can be produced by adding a given percentage of one co-reagent "A" to the other co-reagent "B", and vice-versa, in regulated quantities. The graph is subdivided into areas by curves indicating the length of time necessary to attain the most desirable viscosity of $6 \times 10^5$ cP as a function of the temperature (T°) in degrees centigrade and of the percentage of the pre-polymer formed by adding to A a certain percentage of B or vice-versa ($A + \Delta B$, or $B + \Delta A$), and taking into account the mass, in grams ($M_g$), of the reacting composition. The diagonally hatched area defines the parameters to be satisfied for attaining such viscosity within 40 seconds and the cross-hatched area those for attaining the same viscosity within about 15 seconds.

A few Examples for compositions follow, indicated in parts by weight.

EXAMPLE 1

This Example describes the two components "A" and "B" adapted for forming a cross-linked epoxy-urethane primer layer. The specific actions and scope of certain components have been hereinbelow added, between brackets, for clearer understanding of the compositions and of their effects.

| | | |
|---|---|---|
| "A" | Urethane pre-polymer (such as "Adiprene L 315" by DuPont) (acting as wetting hydrophilous liquid) | 35 |
| | Epoxy resin (such as "Epon 828" by Shell) (acting as wetting liquid) | 15 |
| | Solid oxidized bitumen | 50 |
| | Tar fractionated part for epoxy resin ("Epoxy Tar") (acting as wetting and impregnating liquid) | 15 |
| | Glycidil-ether of tercarboxylic acid (acting as wetting and reactive liquid) | 5 |
| | Baryte (acting as inorganic filler) | 15 |
| | Total parts | 135 |
| "B" | 44'methylene bis(2-chloroaniline (such as "Moca") (solid) | 18 |
| | Low melting (at about 40° C) polyamide resin (such as "Versamid 100" acting also as a wetting agent) | 15 |
| | Solid oxidized bitumen | 65 |
| | "Epoxy Tar" (acting as wetting and impregnating liquid) | 15 |

-continued

| | |
|---|---|
| Dibutylphthalate (acting as a plasticizer and wetting liquid) | 5 |
| Baryte (inorganic filler) | 17 |
| Total parts | 135 |

EXAMPLE 2

This Example describes a composition which is particularly suitable for preparing epoxy primer layers according to the "pre-polymer technique".

| | | |
|---|---|---|
| "A" | Solid oxidized bitumen | 15 |
| | "Epoxy Tar" | 10 |
| | Hard kaolin (such as "Suprex Clay") | 5 |
| | Colloidal silica (such as "Aerosil") | 2 |
| | Wetting, liquid epoxy resin (such as for example "Araldite GY 250" by Ciba) | 68 |
| | Total parts | 100 |
| "B" | Solid bitumen 40/50 | 35 |
| | "Epoxy Tar" | 15 |
| | Cresylic acid | 15 |
| | Wetting and hydrophilous liquid amine (such as for example "Alkamine LT" by Anchor Chemical) | 18 |
| | Hard kaolin | 15 |
| | Liquid hydrophilous accelerator for epoxy resin (such as "D M P 30") | 2 |
| | Total parts | 100 |

EXAMPLE 3

The two-component composition of Example 2 can advantageously be modified to a three-component one by injecting at or near the outlet of the machine, by means of a suitable mixer, 2% by weight of the sum of the two components of tolylene diisocyanate, which promply reacts with the amidic function.

The said "pre-polymer technique" of the invention can advantageously be made use of in an apparatus of the type shown in FIG. 4, for supplying one or more outlets 10 from which the primer layer forming material M is ejected on the road pavement.

The apparatus comprises a twin metering pump 12 actuated by a transmission 14. The pump 12 feeds the components A and, B, respectively (or vice versa) into ducts 16 and 18 at equal rates; these ducts comprise a twin valve system including a twin rotary valve 20 which provides controlled communication between by-pass ducts 26, 28 and said passages 16, 18 to discontinuing the supply when the downstream ducts 22, 24 so that the components are kept circulating during the times in which the ejection of the primer layer forming composition is necessarily discontinued.

By means of auxiliary ducts 30, 32, a suitable solvent is supplied such as from a pressurized supply tank (not shown) and injected into said passages 22 and 24, the ejection being activated by electro-valves 36, 38 controlled by thermostats 40, 42.

A twin valve gear system 44 is located downstream of said passages 22, 24 and comprises metering grooves or adjustable choking passages (the adjustment being provided by axial shifting of said valve member 44) so that the flows into said passages 22, 24 are each equally parted in "primary" flows progressing into downstream ducts 46, 48 and "secondary" flows switched into other ducts 50, 52 which, by means of cross ducts 54, 56, supply the said switched flows into the downstream ducts 48 and 46, respectively.

Therefore, part of each primary flow is switched to form a secondary flow which joins the other primary flow, and vice versa. By adjusting the rates of such flows the formation of pre-polymers having the desired degree of polymerization is provided.

The thus-mixed flows are fed into induction ducts 58, 60 which join into an ejection head 62 including mixer means 64 to ensure the homogeneity of the ejected mixture.

Figure 5:
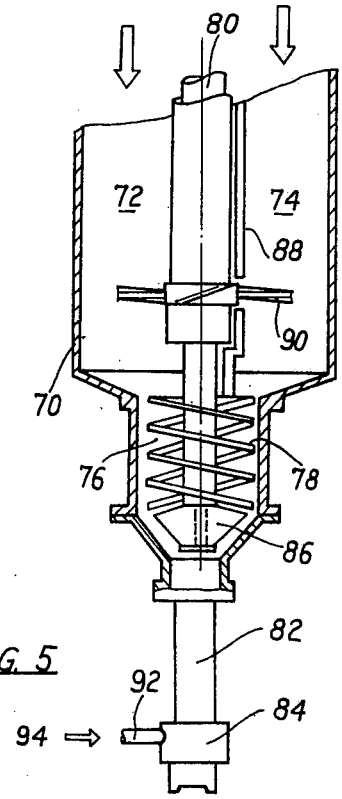
FIG. 5 is a similar view of a simplified embodiment of said apparatus.

A simplified apparatus adapted to be associated with simple and lightweight road marking machines (such as the machine described in the U.K. Patent Specification No. 1,421,483) is shown in FIG. 5. Such apparatus comprises a container 70 divided into compartments 72, 74, each designed for processing and supplying an individual component A and B and each opening into a mixing chamber 76. The processing, feeding and mixing are accomplished by screw means 78 and 86 driven by a pneumatic motor 80, and the screw means to and 86 urge the mixture through an induction duct 82 and one or more outlets 84.

The compartments 72, 74 are separated by a wall 88 provided with an aperture, preferably in the lower part of the apparatus, so that a rotor 90, also driven by motor 80 and having radial vanes or blades, rotates in both compartments and carries metered amounts of the components from one to the other of said compartments, thus promoting the desired pre-polymer formation.

Both the apparatus of FIG. 4 and that of FIG. 5 are provided with means for ejecting residues of the reactive mixture from the outlet means and for cleaning the same when the operation is discontinued. Said ejection and cleaning is favorably accomplished by feeding pressurized air and preferably solvents into said outlets 10 and 84 through a duct 92 connected at 94 to a source (such as a pressurized tank, not shown) of said pressurized air or solvent.

I claim:

1. A method of forming a traffic-regulating indicium on a pavement, comprising forming a primer layer on said pavement by applying thereto a fluid composition which includes cross-linkable components, said composition having such a viscosity upon application thereof to said pavement that said composition intimately contacts said pavement, and said composition being capable of rapidly attaining a viscosity in the range of about $10^3$ to $10^4$ cP when said composition has a viscosity below said range upon being applied to said pavement, said composition further being capable of undergoing an increase in viscosity on said pavement from said range to a higher viscosity of at least $10^5$ cP within a few minutes; and applying a marker tape to said primer layer when the viscosity thereof is approximately in said range to thereby preliminarily bond said marker tape to said primer layer, said marker type becoming more securely bonded to said primer layer as the viscosity of said primer layer increases from said range towards said higher viscosity.

2. The method of claim 1, said primer layer forming a bond with said tape at a viscosity above about $10^5$ cP which is capable of resisting a horizontally applied stress of 1.5 kg/cm$^2$; and wherein said composition is capable of further hardening to a condition such that the bond between said primer layer and said tape is able to withstand a horizontally applied stress of at least 3 kg/cm$^2$.

3. The method of claim 1, wherein said primer layer is impervious and said marker tape is pressed into said primer layer.

4. The method of claim 1, wherein said composition comprises a substantial percentage of said cross-linkable components and at least a portion of the latter is hydrophilous.

5. The method of claim 1, wherein said composition comprises one or more thermoplastic substances which are so compounded with said cross-linkable components as to cause substantial hardening of said primer layer due to heat dissipation and a subsequent further hardening of said primer layer due to cross-linking of said cross-linkable components.

6. The method of claim 5, said composition having a high liquid content but being substantially free of solvent, and said composition including at least 20 percent by weight of said thermoplastic substances; and wherein said cross-linkable components are at least in part hydrophilous and said composition is formed in such a manner that cross-linking of said cross-linkable components at ambient temperatures is promoted.

7. The method of claim 6, wherein said composition is formed by mixing a minor amount of one of said cross-linkable components with a major amount of another of said cross-linkable components so as to obtain a first non-stoichiometric mixture which is capable of undergoing a partial pre-polymerization, mixing a minor amount of said other cross-linkable component with a major amount of said one cross-linkable component so as to obtain a second non-stoichiometric mixture which is capable of undergoing a partial pre-polymerization, and combining said first and second mixtures to obtain said composition, said first and second mixtures being capable of promoting subsequent cross-linking of said one and other cross-linkable components, and said composition being applied to said pavement prior to completion of polymerization so as to permit polymerization to go to completion on said pavement.

8. The method of claim 7, wherein said first and second mixture are permitted to undergo an induction period prior to combining the same so as to permit partial pre-polymerization of said first and second mixtures to occur and thereby permit a rapid hardening of said composition subsequent to the application thereof on said pavement.

9. The method of claim 6, wherein said cross-linkable components hydrophilous epoxy radicals.

10. The method of claim 6, wherein said cross-linkable components comprise highly active hydrophilous urethane radicals.

11. The method of claim 1, wherein said composition is formed by mixing a minor amount of one of said cross-linkable components with a major amount of another of said cross-linkable components so as to obtain a first non-stoichiometric mixture which is capable of undergoing a partial pre-polymerization, mixing a minor amount of said other cross-linkable component with a major amount of said one cross-linkable component so as to obtain a second non-stoichiometric mixture which is capable of undergoing a partial pre-polymerization, and combining said first and second mixtures to obtain said composition, said first and second mixtures being capable of promoting subsequent cross-linking of said one and other cross-linkable components, and said composition being applied to said pavement prior to completion of plymerization so as to permit polymerization to go to completion on said pavement.

12. The method of claim 11, wherein said first and second mixtures are permitted to undergo an induction period prior to combining the same as to permit partial pre-polymerization of said first and second mixtures to occur and thereby permit a rapid hardening of said composition subsequent to the application thereof on said pavement.

13. An arrangement for forming traffic-regulating indicia on pavements, comprising means defining first and second flow paths for respective first and second components capable of cross-linking with one another; means for conveying the first and second components along the respective paths; means for transferring minor amounts of the first component from said first path to said second path and for transferring minor amounts of the second component from said second path to said first path so as to form respective first and second mixtures capable of undergoing pre-polymerization; mixing means downstream of and arranged to communicate with said first and second paths so as to permit the first and second mixtures to be combined with one another to form a composition suitable for application to a pavement; and means for applying the composition to the pavement.

14. An arrangement as defined in claim 13, wherein said transferring means comprises a valve for selectively directing the first component from said first path to said second path and for selectively directing the second component from said second path to said first path.

15. An arrangement as defined in claim 14, wherein said transferring means comprises first and second passages each of which extends between and opens to said first and second paths.

16. An arrangement as defined in claim 14, said first and second paths being defined by respective first and second ducts which extend in substantial parallelism with one another; and wherein said conveying means comprises pump means for feeding the first component along said first path substantially independently of the feeding of the second component along said second path, said pump means being arranged to convey the first component along said first path in a direction which is concurrent with the direction of travel of the second component along said second path.

17. An arrangement as defined in claim 13, comprising induction duct means intermediate said mixing means and the respective paths in order to permit the first and second mixtures to undergo an induction period prior to mixing of the same and thereby enable a rapid hardening of the composition to be achieved subsequent to application of the latter on the pavement.

18. An arrangement as defined in claim 13, wherein said transferring means comprises a member mounted for rotation in said first and second paths.

* * * * *